United States Patent [19]

Sainen et al.

[11] Patent Number: 4,529,012

[45] Date of Patent: Jul. 16, 1985

[54] APPARATUS FOR CONTROLLING MOTOR-DRIVEN LET-OFF MOTION FOR LOOMS

[75] Inventors: Tsutomu Sainen; Yoshitaka Fujita; Toshiyuki Sakano, all of Kanazawa; Toshio Nakagawa, Tsurugi, all of Japan

[73] Assignee: Tsudakoma Corp., Ishikawa, Japan

[21] Appl. No.: 579,249

[22] Filed: Feb. 13, 1984

[30] Foreign Application Priority Data

Feb. 16, 1983 [JP] Japan ..... 58-20071[U]

[51] Int. Cl.[3] ..... D03D 49/06

[52] U.S. Cl. ..... 139/105; 139/108; 139/110

[58] Field of Search ..... 139/99, 97, 103, 109, 139/110, 108; 66/212; 242/75.45, 75.43, 75.44

[56] References Cited

U.S. PATENT DOCUMENTS 3,802,467 4/1974 Steverlynck ..... 139/108
3,878,872 4/1975 Hintsch ..... 139/99

FOREIGN PATENT DOCUMENTS 821576 4/1981 U.S.S.R. ..... 66/212

*Primary Examiner*—Henry S. Jaudon
*Assistant Examiner*—Steve Shongut
*Attorney, Agent, or Firm*—Flynn, Thiel, Boutell & Tanis

[57] ABSTRACT

An apparatus for controlling a let-off motion in a loom having a let-off motion motor includes a tension detector for detecting a warp tension to produce a tension correction signal, a control unit responsive to the tension correction signal for producing a speed signal, a driving amplifier for controlling the let-off motion motor in response to the speed signal, a warp coil diameter detector for issuing a warp coil diameter correction signal inversely proportional to the diameter of a warp coil on a beam to the driving amplifier, and a normal-reverse rotation control unit responsive to the warp coil diameter correction signal for selectively applying prescribed normal- and reverse-rotation signals dependent on a rotation command to the driving amplifier. With this arrangement, the motor is rotated at a desired constant speed for feeding out or rewinding the warp yarn for a desired length irrespectively of the warp coil diameter. In an inching mode of operation, the motor is rotated in a normal or reverse direction for an interval equivalent to one pick each time a main shaft of the loom turns past a certain rotational angle, so that the warp yarn is kept under a desired tension.

3 Claims, 3 Drawing Figures

APPARATUS FOR CONTROLLING MOTOR-DRIVEN LET-OFF MOTION FOR LOOMS

BACKGROUND OF THE INVENTION

1. Field of the Invention

The present invention relates to an apparatus for controlling a motor-driven let-off motion for use in a loom, and more particularly to an apparatus for controlling desired warp feeding when the loom is in inching operation or in a normal- or reverse-rotation mode of operation.

2. Description of the Prior Art

Looms have let-off motions for feeding warp yarns and controlling them to be subjected to constant tension.

Mechanical let-off motions which are generally known in the art are of such a construction that warp yarns will be fed out even when the loom is in a reverse-rotation mode of operation. If this happens, the warp tension will be varied and at the same time the fell will be moved. For restarting the loom, therefore, the warp yarns are requried to be manually wound back, a procedure which is quite troublesome. On looming, the warp yarns are required to be loosened or tensioned at high speed. In the mechanical let-off motions, this has to be done by manually turning a handle with a considerable expenditure of labor.

With electric or motor-driven let-off motions, the warp yarns can be loosened or tensioned simply by manipulating a switch to rotate a let-off motion motor in a normal or reverse direction. Therefore, the manual labor for rotating the handle with the mechanical let-off motions can be dispensed with. However, since the number of RPM of the motor is constant at all times regardless of the diameter of warp coils on beams, the length of unreeled warp yarns varies widely dependent on the warp coil diameter. Even if the switch is turned on for a constant period of time, that is, warp feeding or rewinding is performed for a constant period of time, the length of unreeled warp yarns is greater when the warp coil diameter is larger, and is smaller when the warp coil diameter is smaller. Therefore, the motor-driven let-off motion tends to feed out or rewind the warp yarns excessively even if the switch is manually actuated for a correct interval of time.

While the warp yarns are fed out or rewound by manual switch operation or inching operation in the motor-driven let-off motion, the warp tension undergoes variations, and the unreeled or rewound length of the warp yarns cannot be controlled to a nicety.

SUMMARY OF THE INVENTION

It is an object of the present invention to provide an apparatus for controlling a let-off motion to allow warp yarns to be fed out at a desired speed in relation to the diameter of warp coils on beams while the let-off motion is in a manual switch mode of operation.

Another object of the present invention is to provide an apparatus for controlling a let-off motion in a loom to correct warp tension in relation to the warp coil diameter for thereby moving the fell in the loom.

An automatic control system for a motor-driven let-off motion in a loom has a warp coil diameter detector for detecting the diameter of a warp coil on a beam to generate a warp coil diameter correction signal which is applied to the control system for correcting the number of RPM of a let-off motion motor that rotates the beam.

Acccording to the present invention, the warp coil diameter correction signal from the warp coil diameter detector is utilized to rotate the motor at a required number of RPM in a desired direction during inching operation or to feed the warp yarn in a desired direction at a predetermined speed at all times at the time of looming. The warp coil diameter correction signal is applied to an adding point in a motor-driven let-off motion control system, and also to a normal-reverse rotation control unit for warp feeding operation on looming or inching operation. The normal-reverse rotation control unit is associated with the motor-driven let-off motion control system for controlling the rotation of the let-off motion motor in place of the motor-driven let-off motion control system at the time of feeding the warp thread in a normal or reverse direction on looming or at the time of inching opreaiton. As a consequence, the warp thread can be fed at a desired speed at all times irrespectively of variations of the warp coil diameter as at the time of looming, with the result that erroneous operations such as excessive warp feeding or rewinding can be prevented and warp feeding adjustment can be carried out to a nicety.

The normal-reverse rotation control unit rotates the let-off motion motor in the normal or reverse direction for an interval equivalent to one pick each time the main shaft of the loom turns past a certain rotational angle. Therefore, the desired warp tension will not be subjected to a large variation during inching operation, and the fell will not be moved.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
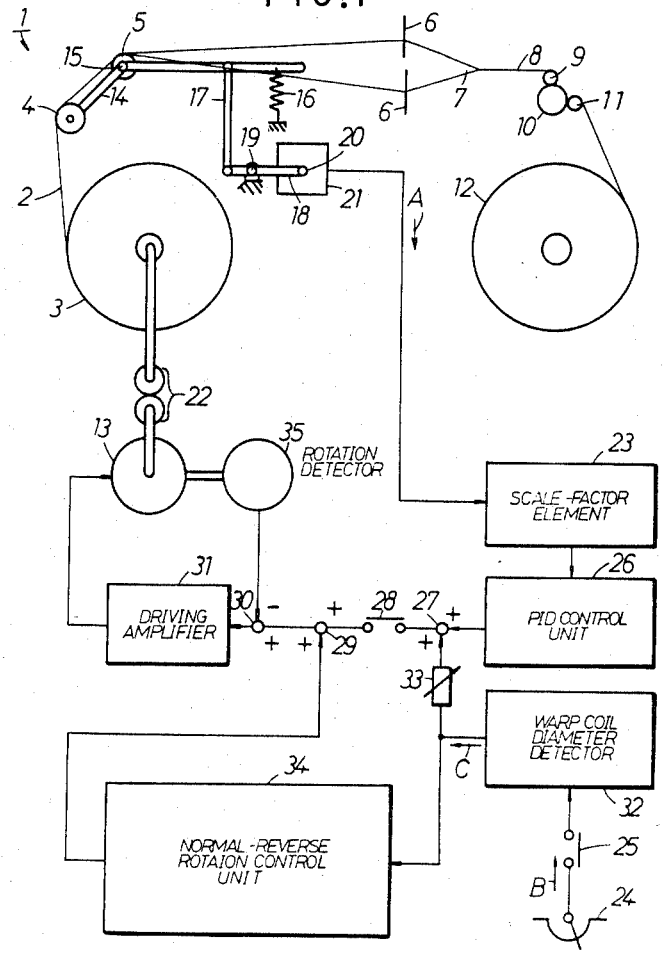
FIG. 1 is a schematic side elevational view of a motor-driven let-off motion in a loom with a control system of the invention for the let-off motion being shown in block form.

FIG. 1 schematically shows a motor-driven let-off motion 1 in a loom according to the present invention. Warp yarns 2 to be controlled are coiled on a feeding beam 3 and fed warpwise through a tensioning roll 4 and a guide roll 5. The warp yarns 2 are then selectively separated into upper and lower groups to form a warp shed in response to selective vertical movement of heddles 6. The warp yarns 2 are woven with a weft yarn 7 into a fabric 8, which is then delivered through a guide roll 9, a takeup roll 10, and a guide roll 11 and finally wound around a takeup beam 12.

The tensioning roller 4 is rotatably supported on an end of a tensioning lever 14 swingably mounted on a shaft 15 on which the guide roller 5 is rotatably mounted. The tensioning lever 14 is normally urged to turn clockwise about the shaft 15 by a tension spring 16 acting on the other end of the tensioning lever 14. Any swinging movement of the tensioning lever 14 is transmitted through a connecting rod 17 as synchronized swinging movement to a lever 18 swingably supported on a shaft 19. The lever 18 supports on a distal end thereof a body 18 to be detected by a tension detector 21 out of contact therewith.

The feeding beam 3 is drivable by a let-off motion motor 13 and a pair of gears 22 operatively coupled with the motor 13 and the beam 3 and having a predetermined gear ratio. The tension detector 21 is electrically connected through a scale-factor element 23 to a PID (proportional-integral-derivative) control unit 26. The PID control unit 26 is connected to a driving amplifier 31 through an adding point 27, operation relay contacts 28, and adding points 29, 30. The driving amplifier 31 is connected to the let-off motion motor 13 for controlling the rotation of the motor 13 in response to an input signal applied to the driving amplifier 31. The diameter of a coil of the warp yarn 2 on the beam 3 is electrically or electromechanically detected by a warp coil diameter detector 32 which is connected to the adding point 27 through a variable resistor 33 and also to the adding point 29 through a normal-reverse rotation control unit 34. To the motor 13, there is coupled a rotation detector 35 for detecting the rotation of the motor 13 and applying a detected signal to the adding point 30 for feedback control of the motor 13 through the driving amplifier 31.

Figure 2:
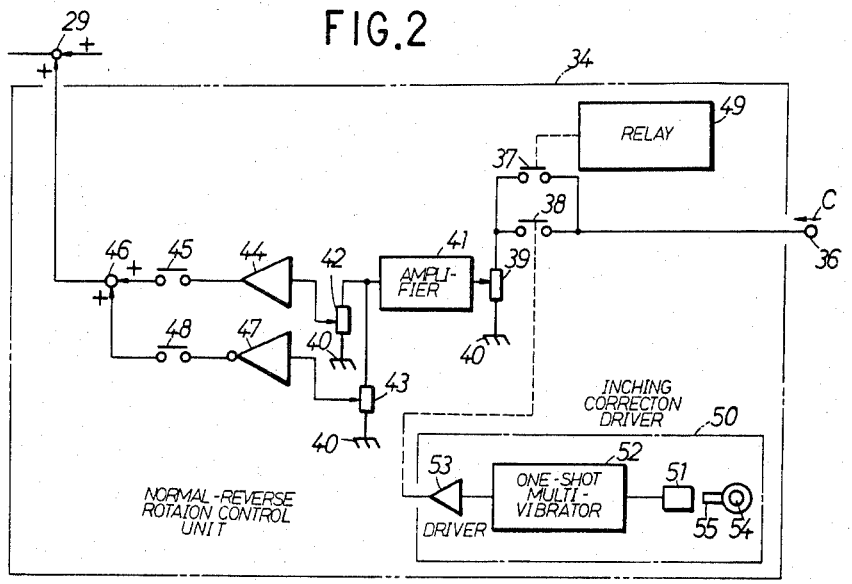
FIG. 2 is a block diagram of a normal-reverse rotation control unit in the control system illustrated in FIG. 1.

FIG. 2 shows in greater detail the normal-reverse rotation control unit 34 according to the present invention. A warp coil diameter correction signal C from the warp coil diameter detector 32 is applied to an input terminal 36 connected through parallel relay contacts 37 and contacts 38 to a variable resistor 39 for setting warp type conditions, the variable resistor 39 being grounded at 40. The variable resistor 39 has a movable terminal or slider connected via an amplifier 41 and adjustment variable resistors 42, 43 to ground at 40. One of the variable resistors 42 has a slider connected through an amplifier 44 and normal-rotation contacts 45 to an adding point 46. The other variable resistor 43 has a slider connected through an inverting amplifier 47 and reverse-rotation contacts 48 to the adding point 46, which is connected to the adding point 29.

The relay contacts 37 are of the normally-open type and drivable by a relay 49. For example, the relay contacts 37 are closed or turned on at the time of looming. The contacts 38 are drivable by an inching correction driver 50. The inching correction driver 50 is composed of a contactless proximity switch 51, a one-shot multivibrator 52 connected to the proximity switch 51, and a driver 53 connected to the one-shot multivibrator 52. The driver 53 issues an output signal for turning on or closing the contacts 38 at the time of inching operation. The proximity switch 51 is disposed for coaction with a body 55 to be detected which is attached to a main shaft 54 of the loom.

Operation of the motor-driven let-off motion 1 will be described.

When the loom is in weaving operation, the motor 13 feeds the warp yarns 2 under a prescribed tension as the weaving proceeds. An initial warp coil diameter of the beam 3 is established by a setting unit 24. More specifically, when a switch 25 for setting an initial warp coil diameter is depressed, the setting unit 24 generates a warp coil signal B representative of an initial warp coil diameter of the beams 3 to initialize the warp coil diameter detector 32. The warp coil diameter detector 32 then issues a warp coil diameter correction signal C in inverse proportion to the warp coil diameter through the operation relay contacts 28 as turned on to the driving amplifier 31. The driving amplifier 31 now controls the number of RPM of the motor 13 with the number of RPM corresponding to an initial speed. The diameter of the coils of the warp yarns 2 on the beams 3 is gradually reduced as the warp yarn 2 are fed out. The warp coil diameter detector 32 detects the diameter of the coils of the warp yarn 2 on the beam 3, generates the warp coil diameter correction signal C in inverse proportion to the warp coil diameter, and delivers the signal C via the variable resistor 33, the adding point 27, and the operation relay contacts 28 to the driving amplifier 31. Accordingly, the driving amplifier 31 progressively increases the number of RPM of the motor 13 as the diameter of the warp coils is reduced.

While the loom is in normal operation, the warp yarns 2 are thus fed out under a desired tension as the weaving progresses. However, the actual tension of the warp yarns 2 tends to vary due to a let-off motion control error and a varying elongation of the warp yarns 2. When the tension of the warp yarns 2 is varied, the lever 14 swings about the shaft 15 in directions dependent on an increase or reduction of the warp tension. The body 20 to be detected then changes its position in one direction or the other. The tension detector 21 detects a displacement of the body 20 and generates a tension correction signal A indicative of the detected displacement. The tension correction signal A is adjusted to an appropriate signal level by the scale-factor element 23. The adjusted signal is applied to the PID control unit 26. The PID control unit 26 processes the tension correction signal A in a P (proportional) control mode, an I (integral) control mode, a PI (proportional-integral) control mode, or a PID (proportional-integral-derivative) control mode. The driving amplifier 31 is therefore supplied with the tension correction signal A as processed and the warp coil diameter correction signal C while the loom is in operation, for correcting the rotational speed of the motor 13. The rotation detector 35 detects the actual number of RPM of the motor 13 and feeds back the same to the adding point 30 for feedback control of the motor 13 through the driving amplifier 31.

When the loom is accidentally stopped due to a weft insertion failure, the loom is then brought into an inching mode of operation. In such an inching mode of operation, the operation relay contacts 28 are turned off or open. The operator actuates a normal inching switch or a reverse inching switch to generate an inching command in either a normal or reverse direction of rotation. The loom then starts inching operation in the normal or reverse rotational direction as long as the inching command is applied.

While the loom is in the normal inching mode, the normal-rotation contacts 45 are turned on or closed. When the main shaft of the loom turns past a point indicative of a predetermined angle such as 0 degree in the normal inching mode, the proximity switch 51 confronts the body 55 on the main shaft 54 and issues a detected signal to the one-shot multivibrator 52. The one-shot multivibrator 52 produces an output signal having a prescribed duration and applies the same to the driver 53. The driver 53 then keeps the contacts 38 closed for the prescribed duration. The warp coil diameter correction signal C from the warp coil diameter detector 32 is then fed through the input terminal 36 to one end of the variable resistor 39, which applies a divided voltage to the amplifier 41. The amplifier 41 amplifies the divided voltage signal and delivers through the variable resistor 42 to the amplifier 44. The amplifier 44 amplifies the applied signal and feeds the amplified signal through the normal-rotation contacts 45 and the adding points 46, 29 to the driving amplifier 31. As a consequence, the driving amplifier 31 energizes the motor 13 for a prescribed interval of time when the main shaft of the loom reaches the point of the predetermined angle or 0 degree. The motor 13 then feeds out a length of the warp yarns 2 which corresponds to a predetermined angle in the normal direction, equivalent to one pick for example, adjusts the warp tension to a desired value, and returns the fell to a normal position.

For a reverse inching mode of operation, the reverse-rotation contacts 48 are turned on in response to actuation of the reverse inching switch.

The length U,in mm, of a warp yarn equivalent to one pick can be given by the following equation:

$$U=10/d \text{ [mm]} \quad (1)$$

where d is the number of occurences of weft beating per centimeter [/cm]. When it is desired to feed the length in a period of time T [sec] sufficiently longer than the time constant of the motor 13, the peripheral velocity V of the beams 3 is expressed by:

$$V=10/dT \text{ [mm/sec]} \quad (2)$$

The above peripheral velocity V can be rewritten as follows:

$$V=\pi DN/60M \text{ [mm/sec]} \quad (3)$$

where N is the number of RPM of the motor 13 [rpm], M the speed reduction ratio between the motor 13 and the beams 3, and D the diameter of the coils of the warp yarns 2 on the beams 3 [mm]. Therefore, the number of RPM N can be given as follows by eliminating the peripheral velocity V from the equations (2) and (3):

$$N=600M/\pi dTD \text{ [rpm]} \quad (4)$$

The speed reduction ratio is inherent in the loom, and the weft beating number d is a constant determined by a fabric to be woven. Accordingly, with the time T being of a fixed value such as 0.5 [sec], the number of RPM N is inversely proportional to the warp coil diameter D. By rotating the motor 13 at the number of RPM which is inversely proportional to the warp coil diameter D for the period of 0.5 [sec] each time the main shaft of the loom passes through the angle of 0 degree while the loom is in a normal (reverse) inching mode of operation, the warp yarns 2 can be fed out (rewound) for a length corresponding to 1 pick.

In actual practice, however, the warp yarns 2 are likely to be fed out for an insufficient length when the motor 13 is rotated at the number of RPM N given by the equation (4) because of a backlash of the gears 22 between the motor 13 and the beams 3. To avoid this difficulty, it is necessary that the motor 13 be rotated at a number of RPM slightly greater than the the number of RPM N given by the equation (4).

The inching correction driver 50 closes the contacts 38 for a period of time corresponding to 1 pick. However, the length to be fed of the warp yarns is not limited to 1 pick, but may be of other values. For example, a rotational angle of the main shaft 54 may be detected by an encoder, and the time constant of the one-shot multivibrator 52 may automatically adjusted by an output from the encoder, so that the contacts 38 can be closed for a period of time proportional to the rotational angle of the main shaft 54. For weaving a fabric which requires no precise control, the contacts 38 may be closed by an inching signal itself.

With the foregoing arrangement, while the loom is in a normal or reverse inching mode of operation, the motor 13 is rotated for a fixed or desired period of time at the number of RPM N dependent on the diameter D of the coils of the warp yarns 2 on the beams 3 and weaving conditions to feed the warp yarns in the normal or reverse direction each time the main shaft of the loom turns past or through a certain rotational angle. The tension of the warp yarns 2 is therefore held under a desired tension and the fell is located in a prescribed position after the inching operation of the loom.

On looming, for example, the relay 49 is energized in coaction with a normal- or reverse-rotation manual switch to keep the relay contacts 37 turned on. The warp coil diameter correction signal C issued from the warp coil diameter detector 32 is initialized by the initial warp coil diameter setting switch 25. The initialized warp coil diameter correction signal C is applied through the input terminal 36 and the relay contacts 37 to one end of the variable resistor 39. The variable resistor 39 then develops a voltage of a value matching the yarn type condition and applies the voltage through the slider to an input terminal of the amplifier 41. If the operator has applied a reverse-rotation command at the time of looming, then the reverse-rotation contacts 48 are turned on to allow the output voltage from the amplifier 41 to be applied through the slider of the variable resistor 43 to the inverting amplifier 47. The inverting amplifier 47 inverts the polarity of the applied input signal and delivers an output signal for reverse rotation through the reverse-rotation contacts 48 and the adding points 46, 29 to the driving amplifier 31. The driving amplifier 31 then enables the motor 13 to feed out the warp yarns 2 at a prescribed speed regardless of variations in the diameters D of the coils of the warp yarns 2 on the beams 3. If a normal-rotation command is given, then the relay contacts 37 and the normal-rotation contacts 45 are turned on, and the same operation as described above is carried out.

As described above, the normal-reverse rotation control unit 34 is responsive to the warp coil diameter correction signal C inversely proportional to the warp coil diameter D for driving the motor 13, so that the length of the warp yarns being fed out can be set to a prescribed value at all times irrespectively of the warp coil diameter D. Accordingly, erroneous operation such as excessive warp feeding or rewinding can be prevented.

While in the embodiment of FIG. 2 the normal-reverse rotation control unit 34 is illustrated as primarily comprising an analog circuit, it may be composed of a digital circuit.

Figure 3:
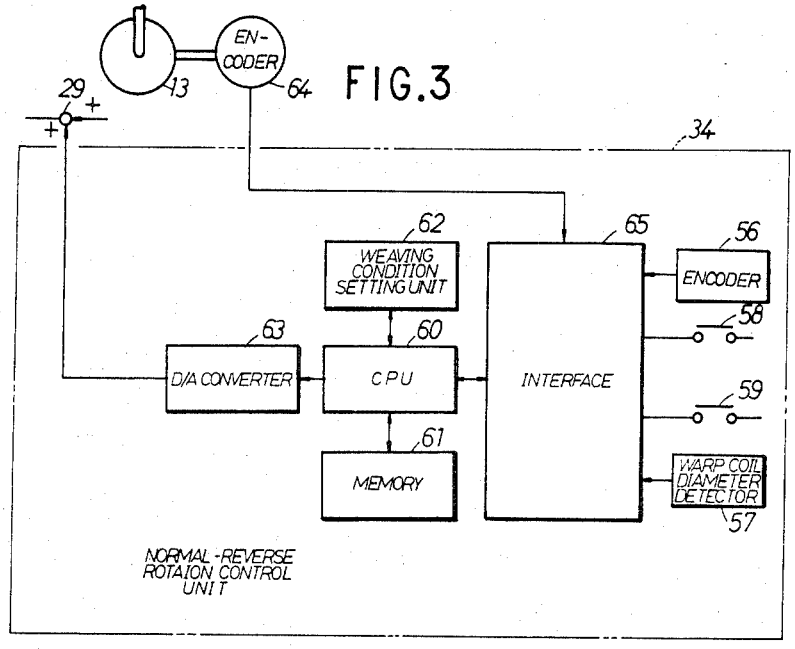
FIG. 3 is a block diagram of a normal-reverse rotation control unit according to another embodiment.

FIG. 3 shows a digital normal-reverse rotation control unit 34. A rotational angle of the main shaft of the loom is detected by an encoder 56, and the detected signal is fed through an interface 65 to a CPU (central processing unit) 60. A digital warp coil diameter correction signal C from a warp coil diameter detector 57 is also fed through the interface 65 to the CPU 60. Signals from a normal inching switch 59 and a reverse inching switch 58 are similarly delivered as command signals via the interface 65 to the CPU 60. The CPU 60 is connected to a memory 61 for storing constants such for example as a speed reduction ratio M and a weaving condition setting unit 62. In relation to information delivered from the setting unit 62 and the memory 61, the CPU 60 generates a signal representative of a required warp length to be fed out when the main shaft of the loom turns through an angle of $\theta$. The warp length U fed out when the main shaft of the loom turns through the angle of $\theta$ can be expressed by the following equation:

$$U=\theta Uo/360 \quad (5)$$

where Uo is the warp length fed out per one pick. If the warp length U is to be fed out in a period of time T [sec], a speed command or the number of RPM N is given by:

$$\begin{aligned} N &= 60MU/\pi Dt \\ &= 600M\theta/360\pi DTB \\ &= 5M\theta/3TdD \text{ [rpm]} \end{aligned} \quad (6)$$

The CPU 60 effects the above calculations to determine the number of RPM N. An output signal indicative of the number of RPM N from the CPU 60 is converted by a D/A converter 63 into an analog signal which is applied as an input signal through the adding points 29, 30 to the driving amplifier 31 (FIG. 1).

In the foregoing embodiments, the diameter D of the warp coils on the beams 3 is directly detected by the warp coil diameter detector 57. However, the warp coil diameter D can also be detected indirectly from the number of RPM N of the motor 13. More specifically, while the loom is in normal operation, the warp feeding operation is stabilized by feedback control, and the number of RPM N of the motor 13 is in inverse proportion to the warp coil diameter D provided that the weaving conditions are constant. Therefore, a reciprocal of the number of RPM N of the motor 13 can be used in place of the diameter D of the warp coils on the beams 3. The encoder 64 shown in FIG. 3 detects the rotation of the motor 13 and feeds the rotation signal through the interface 55 to the CPU 60. The CPU 60 effects the calculations to find the warp coil diameter D at certain intervals of time. Consequently, the warp coil diameter detector 57 can be dispensed with because of the encoder 64. The encoder 64 delivers a signal indicative of the angular displacement of the motor 13 as a feedback signal to the CPU 60 while the loom is in inching operation. This allows a closed-loop control system which is more accurate than an open-loop control system.

Although certain preferred embodiments have been shown and described, it should be understood that many changes and modifications may be made therein without departing from the scope of the appended claims.

What is claimed is:

1. An apparatus for controlling a let-off motion in a loom having a let-off motion motor, comprising:

(a) a tension detector for detecting a warp tension to produce a tension correction signal;

(b) a control unit responsive to said tension correction signal for producing a speed signal;

(c) a driving amplifier for controlling the let-off motion motor in response to said speed signal;

(d) a warp coil diameter detector for issuing a warp coil diameter correction signal inversely proportional to the diameter of a warp coil on a beam to said driving amplifier; and (e) a normal-reverse rotation control unit responsive to said warp coil diameter correction signal for selectively applying prescribed normal- and reverse-rotation signals dependent on a rotation command to said driving amplifier, said normal-reverse rotation control unit comprising an inching correction driver for temporarily rotating the let-off motion motor at a number of RPM dependent on the diameter of the warp coil on the beam and weaving conditions each time a main shaft of the loom turns past a preset rotational angle while the loom is in normal and reverse inching modes of operation.

2. An apparatus according to claim 1, wherein said inching correction driver temporarily rotates said let-off motion motor for an interval equivalent to one pick each time said main shaft of the loom turns past said preset rotational angle.

3. An apparatus according to claim 1, wherein said normal-reverse rotation control unit comprises a digital circuit including an encoder operatively connected to said let-off motion motor and a central processing unit for calculating a signal indicative of the diameter of the warp coil on the beam from an output signal from said encoder.

* * * * *